US009850893B2

(12) United States Patent
Ki et al.

(10) Patent No.: US 9,850,893 B2
(45) Date of Patent: Dec. 26, 2017

(54) RECIPROCATING COMPRESSOR

(71) Applicant: LG Electronics Inc., Seoul (KR)

(72) Inventors: Sunghyun Ki, Seoul (KR); Sangmin Lee, Seoul (KR); Suho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 380 days.

(21) Appl. No.: 14/582,444

(22) Filed: Dec. 24, 2014

(65) Prior Publication Data

US 2015/0184651 A1 Jul. 2, 2015

(30) Foreign Application Priority Data

Dec. 27, 2013 (KR) ..... 10-2013-0166083

(51) Int. Cl.
*F04B 39/12* (2006.01)
*F04C 29/06* (2006.01)
(Continued)

(52) U.S. Cl.
CPC ..... *F04B 53/145* (2013.01); *F04B 17/03* (2013.01); *F04B 35/045* (2013.01);
(Continued)

(58) Field of Classification Search
CPC ..... F04B 39/0027; F04B 39/0033; F04B 39/121; F04C 29/066; F04C 23/008;
(Continued)

(56) References Cited

U.S. PATENT DOCUMENTS 4,559,252 A 12/1985 Motoda et al.
4,924,675 A * 5/1990 Higham ..... F04B 35/045 310/15
(Continued)

FOREIGN PATENT DOCUMENTS

CN 2285381 7/1998
DE 296 02 915 U1 3/1996
(Continued)

OTHER PUBLICATIONS

Chinese Office Action dated Jul. 29, 2016 issued in Application No. 201410826429.6 (English translation attached).
(Continued)

*Primary Examiner* — Peter J Bertheaud
(74) *Attorney, Agent, or Firm* — KED & Associates, LLP

(57) ABSTRACT

A reciprocating compressor is provided that may include a shell including a vibration absorbing member formed to be wound around an outer circumferential surface or an inner circumferential surface or stacked thereon, so that compressor vibration may be attenuated by frictional contact between the shell and the vibration absorbing member or between layers of the vibration absorbing member. Also a noise insulating layer may be formed between the shell and the vibration absorbing member or between the layers of the vibration absorbing member, so that a magnitude of noise may be reduced as vibration noise passes through the noise insulating layer, whereby vibration noise of the compressor, such as noise of a high frequency band, may be further attenuated by fine vibration.

9 Claims, 7 Drawing Sheets

(51) Int. Cl.

| | |
|---|---|
| ***F04D 29/66*** | (2006.01) |
| ***F04B 53/14*** | (2006.01) |
| ***F04B 39/00*** | (2006.01) |
| ***F04B 35/04*** | (2006.01) |
| ***F04B 17/03*** | (2006.01) |

(52) U.S. Cl.
CPC ..... *F04B 39/0027* (2013.01); *F04B 39/0033* (2013.01); *F04B 39/121* (2013.01); *F04C 29/066* (2013.01); *F04D 29/664* (2013.01); *Y10S 417/902* (2013.01)

(58) Field of Classification Search
CPC .... F04C 2240/30; F04C 29/068; F04C 29/06; F04C 29/063; Y10S 417/902; F04D 29/663; F04D 29/664
USPC ..... 417/415–417, 902
See application file for complete search history.

(56) References Cited

U.S. PATENT DOCUMENTS

| | | | | |
|---|---|---|---|---|
| 5,997,258 | A * | 12/1999 | Sawyer, III | F04B 39/0033 181/202 |
| 6,872,057 | B2 * | 3/2005 | Kim | F04B 39/0027 181/202 |
| 7,179,061 | B2 * | 2/2007 | Horton | F04B 39/121 417/220 |
| 7,748,963 | B2 * | 7/2010 | Lee | F04B 35/045 417/415 |
| 2006/0171829 | A1 * | 8/2006 | Ha | F01C 21/104 417/321 |

FOREIGN PATENT DOCUMENTS

| | | | |
|---|---|---|---|
| DE | 10 2011 003133 | A1 | 7/2012 |
| EP | 2 754 969 | A1 | 7/2014 |
| JP | S 49-150906 | | 12/1974 |
| JP | S 51-83818 | | 7/1976 |
| JP | S 58-25683 | | 2/1983 |
| JP | S 58-73975 | | 5/1983 |
| JP | S58-160572 | A | 9/1983 |
| JP | 58-154882 | | 10/1983 |
| JP | S 61-175286 | | 8/1986 |
| JP | S 63-202780 | | 12/1988 |
| JP | H 3-160167 | | 7/1991 |
| JP | 03-189387 | | 8/1991 |
| JP | 05-044777 | | 2/1993 |
| JP | H11-117725 | A | 4/1999 |
| JP | 2003-120531 | | 4/2003 |
| JP | 2009-156141 | | 7/2009 |
| WO | WO 2013/031087 | A1 | 3/2013 |

OTHER PUBLICATIONS

European Search Report dated May 15, 2015 issued in Application No. 14199736.1.

* cited by examiner

RECIPROCATING COMPRESSOR

CROSS-REFERENCE TO RELATED APPLICATION(S)

Pursuant to 35 U.S.C. §119(a), this application claims the benefit of earlier filing date and right of priority to Korean Application No. 10-2013-0166083, filed in Korea on Dec. 27, 2013, the contents of which is incorporated by reference herein in its entirety.

BACKGROUND

1. Field

A reciprocating compressor, and more particularly, to a reciprocating compressor having multiple shells is disclosed herein.

2. Background

In general, a reciprocating compressor is a compressor in which a piston linearly reciprocates within a cylinder to suck, compress, and discharge a refrigerant. The reciprocating compressor may be classified as a connection type reciprocating compressor and a vibration type reciprocating compressor according to a drive scheme of a piston forming a component of a compression mechanism.

In the connection type reciprocating compressor, a piston is connected to a rotational shaft of a rotary motor by a connecting rod and reciprocates within a cylinder to compress a refrigerant. In the vibration type reciprocating compressor, a piston is connected to a mover of a reciprocating motor, so as to vibrate and reciprocate within a cylinder to compress a refrigerant. Embodiments disclosed herein relate to a vibration type reciprocating compressor, and hereinafter, the vibration type linear compressor will be simply referred to as a reciprocating compressor.

The reciprocating compressor may be classified as a fixed type reciprocating compressor, in which a frame that supports a stator of a reciprocating motor, and a cylinder of a compression mechanism is fixed to an inner circumferential surface of a shell, and a movable reciprocating compressor, in which a frame is spaced apart from an inner circumferential surface of a shell. In the fixed type reciprocating compressor, vibration transmitted from an exterior of the shell or vibration generated in an interior of the shell may be directly transmitted to the interior of the shell or the exterior of the shell, increasing vibration noise of the compressor. In contrast, in the movable reciprocating compressor, a support spring may be installed between a shell and a compression mechanism, and thus, vibration transmitted from the exterior of the shell or vibration generated in the interior of the shell may be absorbed by the support spring, rather than being directly transmitted to the interior or exterior of the shell, attenuating vibration noise of the compressor.

FIG. 1 is a cross-sectional view of a related art movable reciprocating compressor. As illustrated, in the related art reciprocating compressor, a compressor body C that compresses a refrigerator in an internal space 11 of an airtight shell 10 is elastically supported by a plurality of support springs 61 and 62.

The compressor body C includes a reciprocating motor 30 installed in the internal space 11 of the shell 10, in which a mover 32 reciprocates, and a compressor mechanism 40, in which a piston 42 is coupled to the mover 32 of the reciprocating motor 30 and reciprocates in a cylinder 41 to compress a refrigerant. The plurality of support springs 61 and 62 is formed as plate springs having an identical natural frequency and installed between the compressor body C and an inner circumferential surface of the shell 10.

In FIG. 1, reference numeral 12 denotes a suction pipe, reference numeral 13 denotes a discharge pipe, reference numeral 20 denotes a frame, reference numeral 31 denotes a stator, reference numeral 31*a* denotes a plurality of stator blocks, reference numeral 31*b* denotes a plurality of pole blocks, reference numeral 35 denotes a coil, reference numeral 32*a* denotes a magnet holder, reference numeral 32*b* denotes a magnet, reference numeral 43 denotes a suction valve, reference numeral 44 denotes a discharge valve, reference numeral 45 denotes a valve spring, reference numeral 46 denotes a discharge cover, reference numerals 51 and 52 denote resonance springs, reference numeral 53 denotes a support bracket that supports the resonance springs, reference numeral 70 denotes a gas bearing, reference letter F denotes a suction flow path, reference numeral S1 denotes a compression space, and reference numeral S2 denotes a discharge space.

In the related art reciprocating compressor discussed above, when power is applied to the reciprocating motor 30, the mover 32 of the reciprocating motor 30 reciprocates with respect to the stator 31. Then, the piston 42 coupled to the mover 32 linearly reciprocates within the cylinder 41 to suck, compress, and discharge a refrigerant.

Here, the compressor body C including the reciprocating motor 30 and the compression mechanism 40 is elastically supported by the plurality of support springs 61 and 62 with respect to the shell 10, absorbs vibration transmitted from an exterior of the shell 10 and vibration generated in an interior of the shell 10 to attenuate vibration noise of the compressor.

However, in the related art reciprocating compressor discussed above, as vibration transmitted from the exterior of the shell 10 or vibration generated in the interior of the shell 10 are attenuated only by the support springs 61 and 62, vibration noise of the compressor cannot be sufficiently attenuated.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of embodiments, with reference to the accompanying drawings. For the sake of brief description with reference to the drawings, the same or equivalent components will be provided with the same reference numbers, and repetitive description thereof has been omitted.

Hereinafter, a reciprocating compressor according to embodiments will be described with reference to the accompanying drawings.

Figure 1:
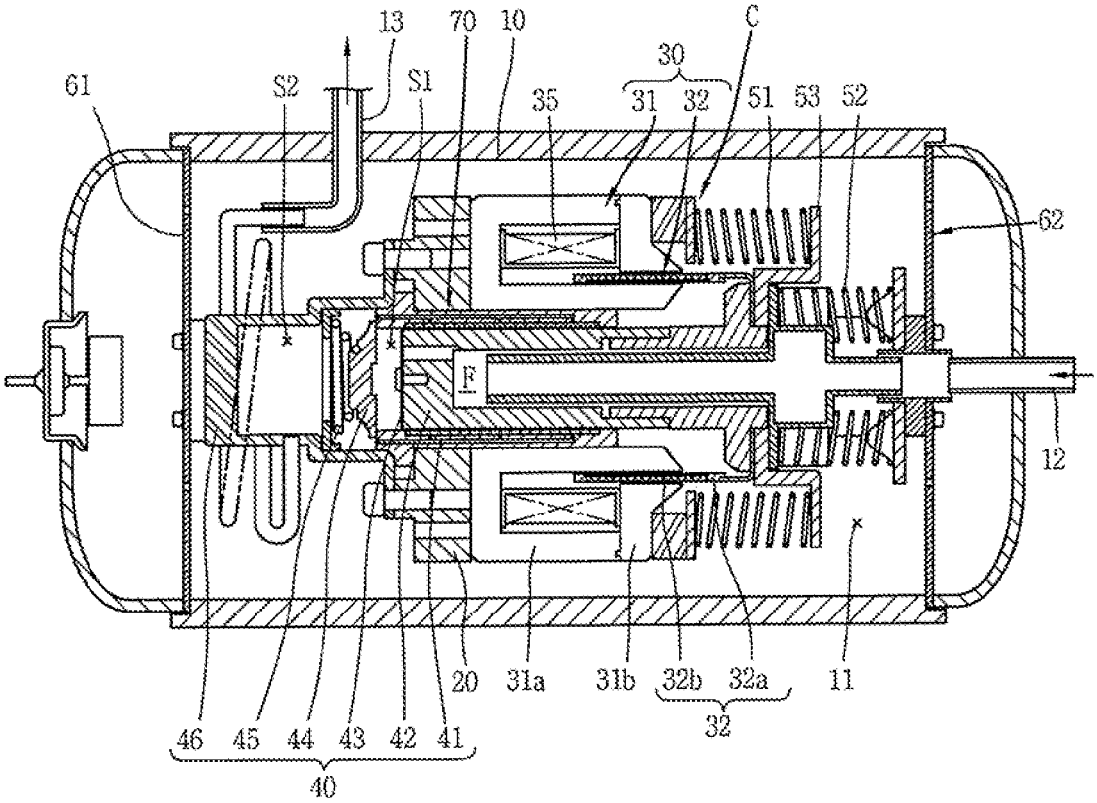
FIG. 1 RELATED ART
FIG. 1 is a cross-sectional view of a related art reciprocating compressor.
Figure 2:
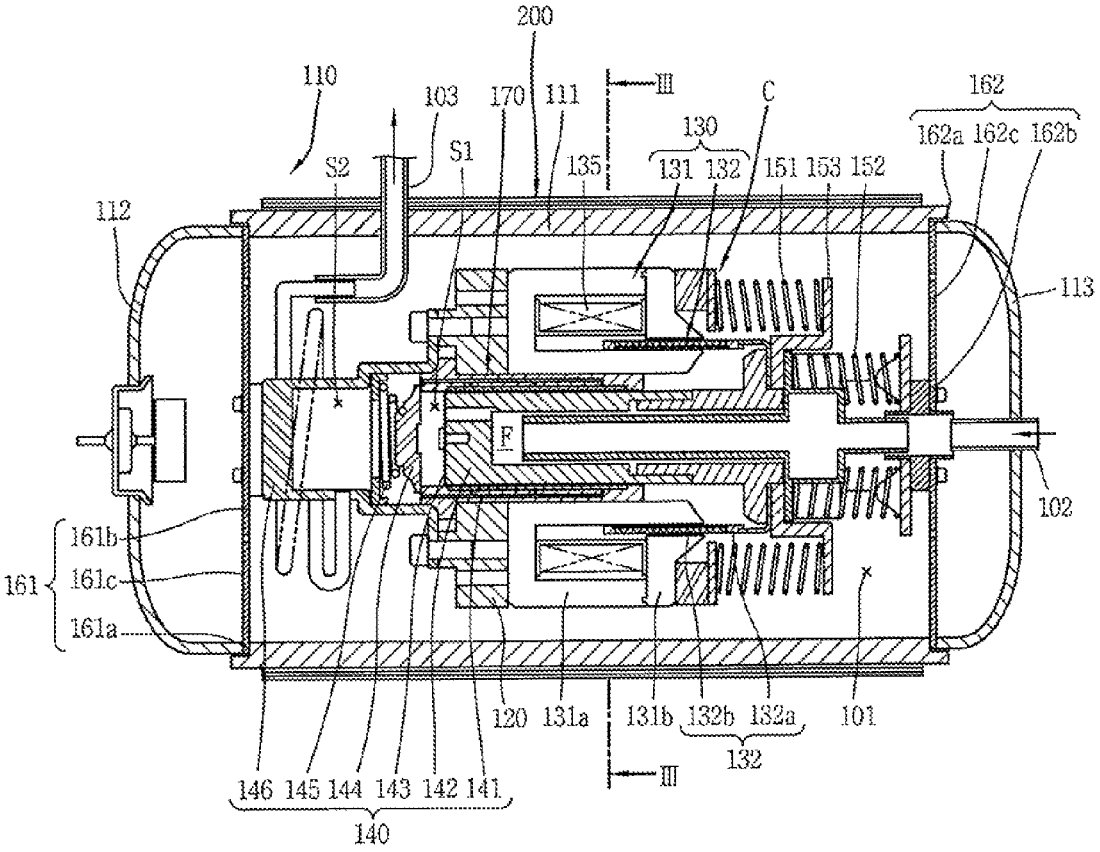
FIG. 2 is a cross-sectional view of a reciprocating compressor according to an embodiment.

FIG. 2 is a cross-sectional view of a reciprocating compressor according to an embodiment. As illustrated in FIG. 2, in the reciprocating compressor according to an embodiment, a frame 120 may be installed in an interior of a hermetically sealed shell 110, and a stator 131 of a reciprocating motor 130 may be installed in the frame 120.

In the reciprocating motor 130, a coil 135 may be insertedly coupled to a stator 131, and an air gap may be formed only at one side based on the coil 135. A mover 132 may include a plurality of magnets 132*b*, which may be inserted in the air gap of the stator 131 and reciprocate in a movement direction of a piston.

The stator 131 may include a plurality of stator blocks 131*a*, and a plurality of pole blocks 131*b*, respectively, coupled to sides of the stator blocks 131*a* to form the air gap (no reference numeral given) together with the plurality of stator blocks 131*a* The plurality of stator blocks 131*a* and the plurality of pole blocks 131*b* may be formed by laminating a plurality of thin stator cores one upon another, so that, when projected in an axial direction, the plurality of stator blocks 131*a* and the plurality of pole blocks 131*b* may have a circular arc shape. The plurality of stator blocks 131*a* may have a recess (ㄷ) shape when projected in the axial direction, and the plurality of pole block 131*b* may have a rectangular shape (ㄷ) shape when projected in the axial direction.

The mover 132 may include a magnet holder 132*a*, and the plurality of magnets 132*b* coupled to an outer circumferential surface of the magnet holder 132*a* in a circumferential direction to form magnetic flux together with the coil 35. The magnet holder 132*a* may be formed of a non-magnetic material to prevent leakage of magnetic flux; however, embodiments are not limited thereto. Alternatively, the magnet holder 132*a* may be formed of a magnetic material. An outer circumferential surface of the magnet holder 132*a* may have a circular shape to allow the plurality of magnets 132*b* to be attached thereto in a line contact manner. A magnet installation recess (not shown) may be formed in a band shape on an outer circumferential surface of the magnet holder 132*a* to allow the plurality of magnets 132*b* to be inserted therein and supported in a movement direction.

The plurality of magnets 132*b* may have a hexahedral shape and may be individually attached to the outer circumferential surface of the magnet holder 132*a*. When the plurality of magnets 132*b* is individually attached to the outer circumferential surface of the magnet holder 132*a*, the outer circumferential surfaces of the plurality of magnets 132*b* may be fixedly covered by a support member (not shown), such as a separate fixing ring, or a tape formed of a composite material, for example.

The plurality of magnets 132*b* may be continuously attached to the outer circumferential surface of the magnet holder 132*a* in a circumferential direction. Alternatively, the stator 131 may include the plurality of stator blocks 131*a* arranged to be spaced apart from one another by a predetermined gap in the circumferential direction, and the plurality of magnets 132*b* may be attached at a predetermined gap, namely, a gap equal to the gap between the plurality of stator blocks 131*a*, in a circumferential direction on the outer circumferential surface of the magnet holder 132*a*, in order to minimize usage of the plurality of magnets 132*b*.

In order to ensure a stable reciprocating movement, the plurality of magnets 132*b* may be formed such that a length thereof of each in a movement direction is not smaller than a length of the air gap in the movement direction, specifically, greater than the length of the air gap in the movement direction, and disposed such that at least one end of each magnet 132*b* in the movement direction is positioned within the air gap at an initial position or during an operation. Only one magnet may be disposed in the movement direction, or a plurality of magnets may be disposed in the movement direction. Each magnet 132*b* may be disposed such that an N pole and an S pole correspond to the movement direction.

In the reciprocating motor 130, the stator 131 may have a single air gap, or the stator 131 may have an air gap (not shown) on both sides thereof in a reciprocating direction based on the coil 135. In this case, the mover 132 may be formed in the same manner as that of the previous embodiment.

A cylinder 141 forming a compression mechanism 140 together with the stator 131 of the reciprocating motor 130 may be fixed to the frame 120, and a piston 142 may be inserted in the cylinder 141, such that the piston 142 reciprocates therein. The piston 142 may be coupled to the mover 132, such that the piston 142 reciprocates together with the mover 132 of the reciprocating motor 130. Resonance springs 151 and 152 that induce the piston 142 to make a resonant movement may be installed on both sides of the piston 142 in the movement direction, respectively.

A compression space S1 may be formed in the cylinder 141. A suction flow path F may be formed in the piston 142. A suction valve 143 to open and close the suction flow path F may be installed at an end of the suction flow path F. A discharge valve 144 to open and close the compression space S1 of the cylinder 141 may be installed in or at a front end surface of the cylinder 141, and a discharge cover 146 to fix the cylinder 141 to the frame 120 and that accommodates the discharge valve 144 may be coupled to the frame 120. In FIG. 2, reference numeral 52 denotes a discharge space.

A fluid bearing 170 may be formed in the cylinder 141. The fluid bearing 170 may include a plurality of rows of gas holes (not shown) that penetrates from a front end surface of the cylinder 141 to an inner circumferential surface thereof. The fluid bearing 170 may have any structure as long as it guides a refrigerant discharged to a discharge cover 146, to between the cylinder 141 and the piston 142 to support the cylinder 141 and the piston 142.

A first support spring 161 that supports compressor body C in a horizontal direction may be installed between the discharge cover 146 and a front side of the shell 110, and a second support spring 162 that supports the compressor body C in the horizontal direction may be installed between the resonance spring, specifically, the spring bracket 153 that supports the resonance spring, and the rear side of the shell 110.

The first support spring 161 and the second support spring 162 may be configured as plate springs, as illustrated in FIG. 2. For example, a first fixed portion 161*a* fixed to the front side of the shell 110 may be formed at an edge of the first support spring 161, and a second fixed portion 161*b* fixed to a front side of the discharge cover 146 may be formed at a center of the first support spring 161. An elastic portion 161*c* cut in a spiral shape may be formed between the first fixed portion 161*a* and the second fixed portion 161*b*.

A first fixed portion 162*a* fixed to a rear side of the shell 110 may be formed at an edge of the second spring 162, and a second fixed portion 162*b* fixed to the support bracket 153 that supports the resonance spring 152 may be formed at a center of the second spring 162. An elastic portion 162*c* cut in a spiral shape may be formed between the first fixed portion 162*a* and the second fixed portion 162*b*.

In FIG. 2, reference numeral 101 denotes an internal space, reference numeral 102 denotes a suction pipe, reference numeral 103 denotes a discharge pipe, reference numeral 145 denotes a valve spring, reference numeral 111 denotes a body shell, reference numeral 112 denotes a front shell, reference numeral 113 denotes a rear shell, and reference numeral 200 denotes a vibration absorbing member.

An operation of reciprocating compressor according to this embodiment will be described hereinbelow.

When power is applied to the coil 135 of the reciprocating motor 130, the plurality of magnets 132*b* provided in the mover 132 of the motor 130 may generate bi-directional induced magnetism together with the coil 135, whereby the mover 132 may reciprocate with respect to the stator 131 by the induced magnetism and elastic force of the resonance springs 151 and 152. Then, the piston 142 coupled to the mover 32 may linearly reciprocate within the cylinder 141 to suck a refrigerant, compress the refrigerant, and subsequently discharge the compressed refrigerant to outside of the compressor.

At this time, the mover 132 of the reciprocating motor 130 may reciprocate in a horizontal direction with respect to the stator 131, and at the same time, the piston 142 may reciprocate in the horizontal direction with respect to the cylinder 141, generating vibration in the horizontal direction. The vibration may be attenuated by the first support spring 161 and the second support spring 162 that elastically support the compressor body C with respect to the shell 110, and thus, vibration generated in the interior of the shell 110 and transmitted to the exterior of the shell 110 may be attenuated, thus reducing vibration noise of the compressor. Of course, vibration transmitted through the shell 110 from the exterior of the shell 110 may also be attenuated by the first support spring 161 and the second support spring 162, reducing vibration noise of the compressor.

However, vibration transmitted from the exterior of the shell 110 or vibration generated in the interior of the shell 110 may not be sufficiently attenuated by only the first support spring 161 and the second support spring 162. Thus, in this embodiment, vibration absorbing member 200 forming an outer shell or an inner shell may be installed on an outer circumferential surface or an inner circumferential surface of the shell 110 in order to form a frictional damping and noise insulating layer between the shell 110 and the vibration absorbing member 200 or between layers of the vibration absorbing member 200 to thus reduce noise. When the vibration absorbing member 200 is installed on the outer circumferential surface of the shell 110, the shell 110 forms an inner shell, and the vibration absorbing member 200 forms an outer shell, and when the vibration absorbing member 200 is installed on an inner circumferential surface of the shell 110, the shell 110 forms an outer shell and the vibration absorbing member 200 forms an inner shell 110 will be described. Hereinafter, an example in which the vibration absorbing member 200 is installed on the outer circumferential surface of the shell will be described. Installation of the vibration absorbing member 200 on the inner circumferential surface of the shell 110 and installation of the vibration absorbing member 200 on the outer circumferential surface of the shell 10 may be the same or similar in construction or operational effects.

Figure 3:
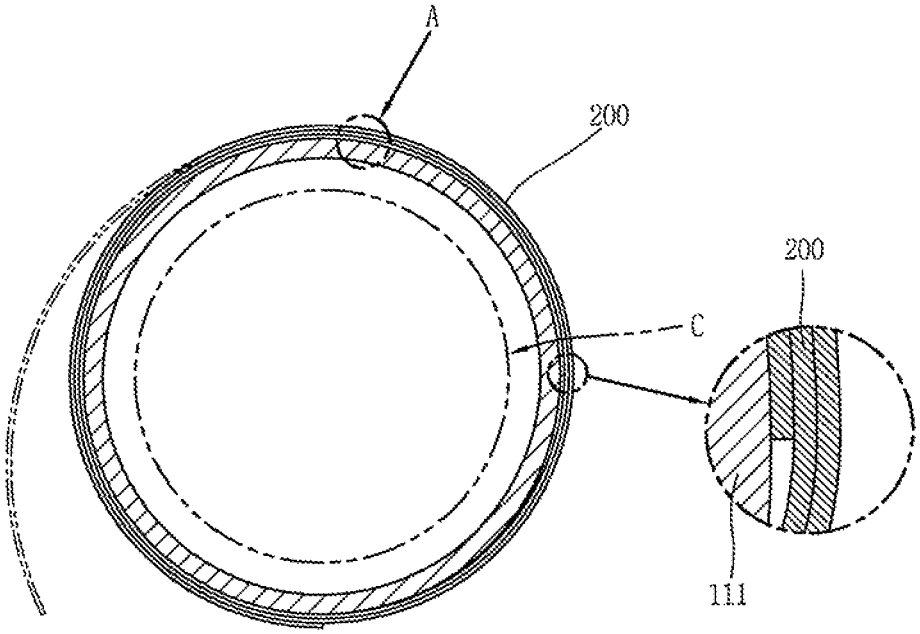
FIG. 3 is a cross-sectional view illustrating an embodiment of a vibration absorbing member forming an outer shell, taken along line III-III of FIG. 2.
Figure 4:
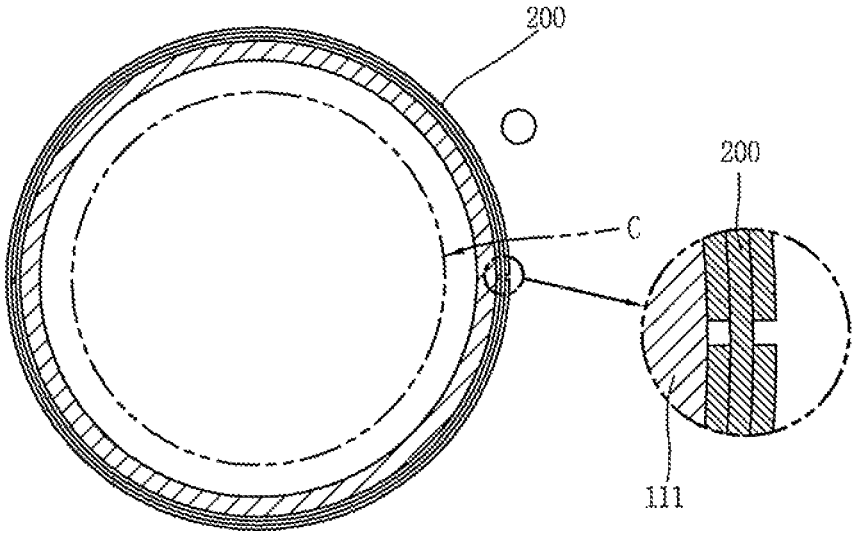
FIG. 4 is a cross-sectional illustrating another embodiment of a vibration absorbing member forming an outer shell, taken alone line of FIG. 2.

FIG. 3 is a cross-sectional view illustrating an embodiment of a vibration absorbing member forming an outer shell, taken along line ill-Ill of FIG. 2. FIG. 4 is a cross-sectional illustrating another embodiment of a vibration absorbing member forming an outer shell, taken alone line III-III of FIG. 2. FIGS. 5 through 8 are cross-sectional views illustrating embodiments of a vibration absorbing member, in which a portion "A" of FIG. 3 is enlarged to be shown.

As illustrated in FIGS. 3, 4, and 5 through 8, the shell of the reciprocating compressor according to embodiments may include body shell 111 having a cylindrical shape, and front shell 112 and rear shell 113, which may be, for example, welded, to a front end and a rear end of the body shell 110 in order to cover a front side and a rear side of the body shell 111, respectively. The first support spring 161 and the second spring 162 as described above may be inserted between the body shell 111 and the front shell 112 or between the body shell 111 and the rear shell 113, and may be, for example, welded together, respectively. Step surfaces (no reference numerals are given) may be formed on both ends of the front and rear of the body shell 110 to allow the first support spring 161 and the second support spring 162 to be mounted thereon.

In a state in which the first support spring 161 is mounted on the front side step surface, the front shell 112 may be mounted on the first support spring 161, and may be, for example, welded to couple the body shell 111, the first support spring 161, and the front shell 112. In a state in which the second support spring 162 is mounted on the rear side step surface, the rear shell 113 may be mounted on the second support spring 162, and may be, for example, welded to couple the body shell 111, the second support spring 162, and the rear shell 113.

The vibration absorbing member 200 may be formed as a thin plate member which may be wound around on the body shell 111 at least one or more times. The vibration absorbing member 200 may use a plate body having a thickness greater than a thickness the shell 110, but in such a case, it may be difficult to wind the vibration absorbing member 200. Thus, as illustrated in FIGS. 2 through 8, a member having a thickness equal to or smaller than a thickness of the shell 100 may be used as the vibration absorbing member 200.

As the vibration absorbing member 200 may be formed by winding a thin plate member a plurality of times (forming a plurality of layers), the vibration absorbing member 200 may be formed of a material having a weight smaller than a weight of the shell 100 to reduce a weight of the compressor. Also, the vibration absorbing member 200 may be formed of a material having a greater stiffness than a stiffness of the shell 100 in order to prevent sagging, for example.

Also, as a number of windings of the vibration absorbing member 200 increases, noise insulating layers may be increased to further effectively reduce vibration of the compressor. However, if the number of layers of the vibration absorbing member 200 is too excessive, the overall weight of the compressor, as well as material costs, may increase, and thus, a total thickness of the vibration absorbing member 200 may be smaller than or equal to the thickness of the shell 110 of the compressor, or may be equal to or smaller than 1.5 times the thickness of the shell 110.

Also, for the vibration absorbing member 200, a single plate member having a width similar to a width of the body shell 111, as illustrated in FIG. 2, may be used to cover the shell 110. In this case, however, it may be difficult to wind the plate member, and thus, the plate member may be divided into at least two parts or portions and wound around the body shell 111 in a lengthwise direction. The vibration absorbing member 200 may be wound around the body shell 111, as illustrated in FIG. 3, or a plurality of vibration absorbing members 200 may be formed to have a snap ring shape and stacked in order to cover the body shell 111, as illustrated in FIG. 4.

Figure 5:
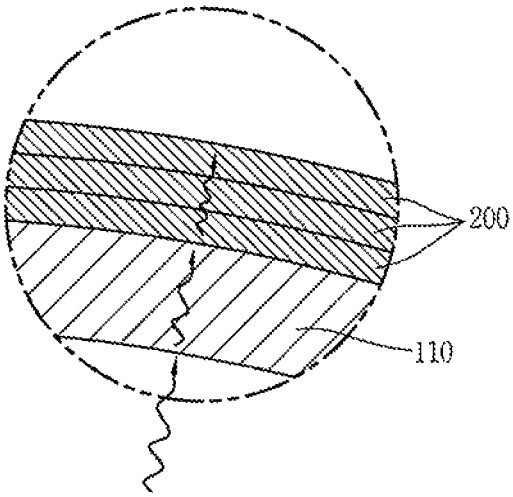
FIGS. 5 through 8 are cross-sectional views illustrating embodiments of a vibration absorbing member, in which a portion "A" of FIG. 3 is enlarged.
Figure 6:
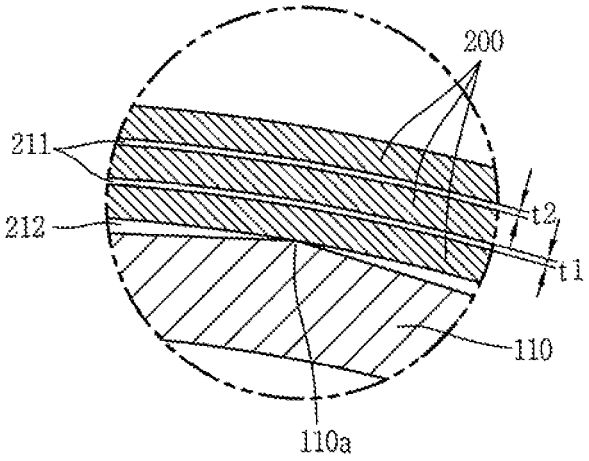

As illustrated in FIG. 5, the layers of the vibration absorbing member 200 may be tightly attached to attenuate noise due to frictional contact, or alternatively, as illustrated in FIG. 6, the shell 110 and the vibration absorbing member 200 and the layers of the vibration absorbing member 200 may be spaced apart from one another by fine gaps t1 and t2, respectively, to form spaces 211. As the spaces 211 form discontinuous points of vibration noise, namely, noise insulating layers, noise of the compressor may be further reduced.

Figure 7:
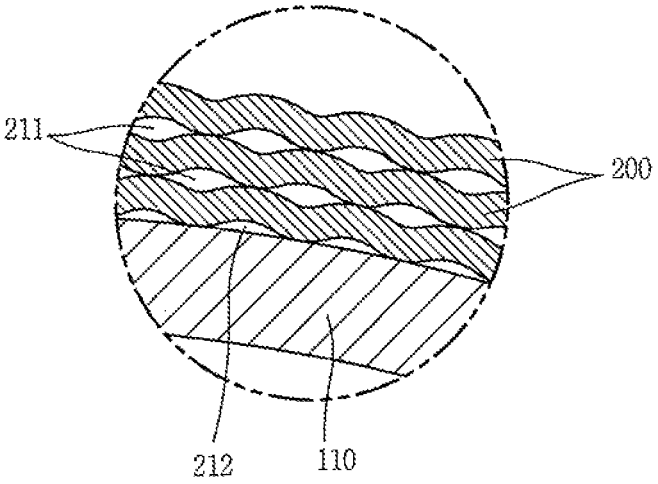

The spaces 211 may be naturally generated during a process of winding to form the vibration absorbing member 200, or as illustrated in FIG. 7, the spaces 211 may be forcibly formed by embossing the vibration absorbing member 200.

Figure 8:
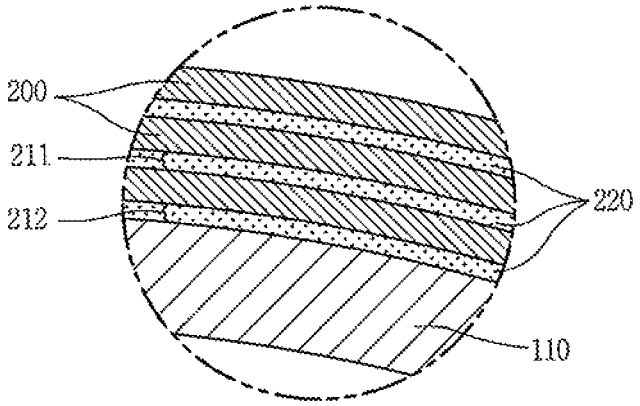

The spaces 211 each may be formed as an empty space forming a kind of air layer, or as illustrated in FIG. 8, the spaces 211 may be filled with a polymer absorbing material 220 formed of a powder material to increase a vibration noise attenuation effect.

A frictional damping effect and a noise insulating layer may be required between an inner circumferential surface of an innermost layer of the vibration absorbing member, which may be wound at an innermost portion, and an outer circumferential surface of the shell 110. Thus, protrusions 110*a*, such as angular protrusions, or concave-convex protrusions, for example, may be formed on the outer circumferential surface of the shell 110 in contact with the inner circumferential surface of the innermost layer of the vibration absorbing member 200, such that shapes of a cross-section of the shell 110 and a cross-section of the vibration absorbing member 200 are different, as illustrated in FIG. 6. Accordingly, a space 212 may be formed between the shell 110 and the vibration absorbing member 200 to attenuate vibration noise between the shell 110 and the vibration absorbing member 200.

Figure 9:
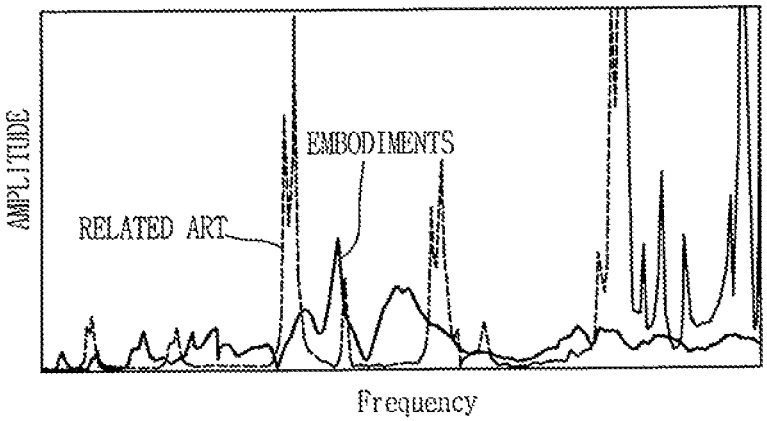
FIG. 9 is a graph illustrating an effect of reducing vibration of a vibration absorbing member of the reciprocating compressor of FIG. 2.

As described above, in the vibration absorbing member 200 according to this embodiment, both ends thereof in the winding direction may overlap with each other one or more times, namely, one or more layers may overlap with each other, generating frictional damping between the layers of the vibration absorbing member 200, and thus, even though vibration is generated in the interior of the shell 110 or vibration is transmitted from the exterior of the shell 110, vibration noise of the compressor may be attenuated, as illustrated in FIG. 9. In particular, in the noise insulating layer, noise of a high frequency band may be more effectively attenuated due to fine vibration.

Another embodiment of a shell of a reciprocating compressor according to embodiments will be described hereinbelow.

Figure 10:
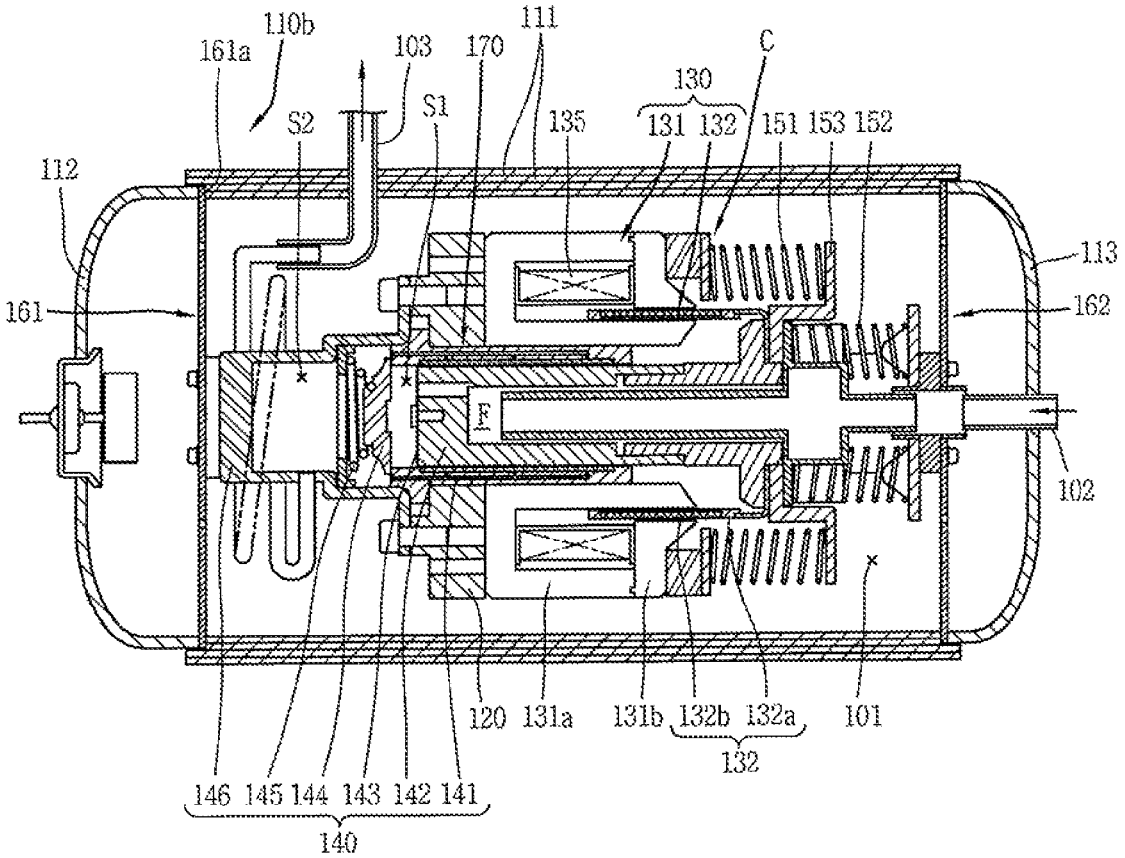
FIG. 10 is a cross-sectional view illustrating another embodiment of a reciprocating compressor.

As illustrated in FIG. 10, body shell 110*b* may be formed to have a cylindrical shape by winding a single plate member several times, so as to serve as a vibration absorbing member itself. In this case, the body shell 110*b* may be sealed by welding an inner circumferential end or an outer circumferential end (the outer circumferential end in the drawing) of the plate member. Also, in this case, the plate member may be tightly attached or may be spaced apart by a predetermined gap to form a space layer or an absorbing material may be interposed between layers. A basic configuration and operational effect thereof are similar to those of the previous embodiment described above. However, in this embodiment, as the body shell 110*b* may be formed by winding a single plate member several times, a number of components may be reduced and an assembling process may be simplified to reduce manufacturing costs and reduce a weight of the compressor, compared with a case in which the shell and the vibration absorbing member are separately manufactured and assembled as in the previous embodiment.

Embodiments disclosed herein provide a reciprocating compressor in which vibration transmitted from an exterior of a shell or vibration generated in an interior of the shell may be effectively attenuated.

Embodiments disclosed herein provide a reciprocating compressor that may include a shell having an internal space; a reciprocating motor installed in the internal space of the shell and having a mover that reciprocates; a compression mechanism unit coupled to the mover of the reciprocating motor to reciprocate together to compress a refrigerant; and a vibration absorbing member installed to cover at least any one of an inner circumferential surface or an outer circumferential surface of the shell by one or more layers. Accordingly, vibration transmitted through the shell may be attenuated by frictional contact between layers of the vibration absorbing member, as well as by frictional contact between the shell and the vibration absorbing member.

The vibration absorbing member may be formed such that two or more layers thereof overlap with each other at an end portion thereof in a direction in which the vibration absorbing member is wound, or a plurality of vibration absorbing members having both ends may be stacked in a circumferential direction layer upon layer. Accordingly, a contact area between the layers of the vibration absorbing members may be increased to further increase a vibration attenuation effect.

An overall thickness of the vibration absorbing member may be equal to or greater than a thickness of the shell in order to prevent an excessive increase in the weight and material costs of the overall compressor. The shell and the vibration absorbing member or the layers of the vibration absorbing member may be tightly attached to increase a noise attenuation effect based on frictional contact.

The shell and the vibration absorbing member or the layers of the vibration absorbing member may be spaced apart from one another by a predetermined gap to form a space portion or space, whereby an air layer may be formed to further reduce vibration noise. The shell and the vibration absorbing member may have cross-sections in different shapes to form the space portion, or the vibration absorbing member may have an embossed cross-section to form a space portion or space between the vibration absorbing members. A vibration absorbing member formed of a polymer may be inserted into the space portion to further increase a vibration attenuation effect.

The shell and the vibration absorbing member may be formed of different materials. The vibration absorbing member may be formed of a material lighter than a material of the shell in order to prevent an excessive increase in weight of the compressor. The vibration absorbing member may be formed of a material having stiffness superior to that of the shell, in order to prevent sagging, for example.

The vibration absorbing member may be formed to have a thickness smaller than or equal to that of the shell in order to prevent an excessive increase in a total weight of the compressor. The vibration absorbing member may be coupled by being divided two or more parts or portions in a lengthwise direction of the shell in order to facilitate a coupling operation of the vibration absorbing member.

Embodiments disclosed herein further provide a reciprocating compressor that may include a shell; a compressor body installed within the shell to compress a refrigerant; and a support spring configured to elastically support the compressor body with respect to the shell. The shell may include an inner shell and an outer shell, and at least any one of the inner shell or the outer shell may be formed to include a plurality of layers, whereby vibration may be attenuated by interlayer frictional contact of the plurality of layers or an interlayer air layer. The inner shell and the outer shell may be formed of different materials.

The inner shell and the outer shell or the layers of the shell formed to include a plurality of layers, among the inner shell and the outer shell, may be tightly attached. Alternatively, air layer may be formed between the inner shell and the outer shell or between the layers of the shell formed to include a plurality of layers, among the inner shell and the outer shell.

The shell formed to include a plurality of layers, among the inner shell and the outer shell, may have an irregular cross-section to form an air layer. An absorbing material may be inserted between the inner shell and the outer shell or between the layers of the shell formed to include a plurality of layers, among the inner shell and the outer shell, in order to absorb vibrations.

The compression mechanism unit may be configured such that a piston is slidably inserted into a cylinder forming a compression space, and a fluid bearing may be provided in the compression mechanism unit to supply a fluid between the cylinder and the piston to support the piston with respect to the cylinder. Accordingly, there is no need to store separate oil in an internal space of the shell, reducing an oil storage space, and as an oil supply unit is eliminated, the compressor structure may be simplified. Also, a degradation of efficiency of the compressor due to shortage of oil may be prevented in advance.

Embodiments disclosed herein further provide a reciprocating compressor that may include a shell having an internal space; a reciprocating motor installed in the internal space of the shell and having a mover that reciprocates; and a compression mechanism unit coupled to the mover of the reciprocating motor to reciprocate together to compress a refrigerant. The shell may be formed by winding a single plate member such that two or more layers overlap with each other.

According to the reciprocating compressor according to embodiments, even though vibration may be generated in the shell or vibration may be transmitted to the shell from the outside, the vibration may be attenuated by frictional contact between the shell and the vibration absorbing member or between the layers of the vibration absorbing member. Also, as the noise insulating layer may be formed between the shell and the vibration absorbing member or between the layers of the vibration absorbing member, a magnitude of noise may be reduced as vibration noise passes through the noise insulating layer, whereby vibration noise of the overall compressor, such as noise of a high frequency band, for example, may be attenuated by fine vibration.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

The foregoing embodiments and advantages are merely exemplary and are not to be considered as limiting. The teachings can be readily applied to other types of apparatuses. This description is intended to be illustrative, and not to limit the scope of the claims. Many alternatives, modifications, and variations will be apparent to those skilled in the art. The features, structures, methods, and other characteristics of the embodiments described herein may be combined in various ways to obtain additional and/or alternative exemplary embodiments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising a shell having an internal space;

a reciprocating motor installed in the internal space of the shell and having a mover that reciprocates;

a compression mechanism coupled to the mover of the reciprocating motor to reciprocate together to compress a refrigerant; and at least one vibration absorbing member installed to cover an outer circumferential surface of the shell by two or more layers in order to form frictional contact between the shell and the at least one vibration absorbing member or between the two or more layers of the at least one vibration absorbing member to reduce noise by frictional damping, wherein the shell and the at least one vibration absorbing member or layers of the at least one vibration absorbing member are spaced apart from one another by a predetermined gap to form a space therebetween, wherein the at least one vibration absorbing member is formed as single plate wound around the shell such that the two or more layers of the at least one vibration absorbing member overlap with each other in a direction in which the vibration absorbing member is wound, wherein the at least one vibration absorbing member is formed of a material having a stiffness greater than a stiffness of the shell, and wherein the vibration absorbing member is formed as a thin plate member which is equal to or thinner than a wall of the shell.

2. The reciprocating compressor of claim 1, wherein the shell and the at least one vibration absorbing member or layers of the at least one vibration absorbing member are tightly attached.

3. The reciprocating compressor of claim 1, wherein the shell and the at least one vibration absorbing member have cross-sections in different shapes to form the space.

4. The reciprocating compressor of claim 1, wherein the at least one vibration absorbing member has an irregular cross-sectional shape to form the space.

5. The reciprocating compressor of claim 3, wherein the at least one vibration absorbing member is embossed.

6. The reciprocating compressor of claim 1, wherein an absorbing material is inserted in the space.

7. The reciprocating compressor of claim 1, wherein the shell and the at least one vibration absorbing member are formed of different materials.

8. The reciprocating compressor of claim 7, wherein the at least one vibration absorbing member is formed of a material lighter in weight than a material of the shell.

9. The reciprocating compressor of claim 1, wherein the at least one vibration absorbing member is divided into two or more portions in a lengthwise direction of the shell.

* * * * *